United States Patent [19]

Jaquay

[11] 4,175,732

[45] Nov. 27, 1979

[54] MELTING OF FINE PARTICULATE MATERIAL IN A HIGH-SPEED ROTARY FURNACE

[75] Inventor: Louis H. Jaquay, Pittsburgh, Pa.

[73] Assignee: Dravo Corporation, Pittsburgh, Pa.

[21] Appl. No.: 889,743

[22] Filed: Mar. 24, 1978

Related U.S. Application Data

[62] Division of Ser. No. 764,083, Jan. 31, 1977, Pat. No. 4,094,667.

[51] Int. Cl.[2] ..... F27B 7/32; F27B 7/34

[52] U.S. Cl. ..... 266/213; 266/244

[58] Field of Search ..... 65/335, 347; 266/142, 266/143, 145, 158, 213, 225, 226, 244, 248; 432/103, 105, 117

[56] References Cited

U.S. PATENT DOCUMENTS

| | | | |
|---|---|---|---|
| 2,337,072 | 12/1943 | Tarbox | 266/213 |
| 2,455,531 | 12/1948 | Stroman | 432/105 |
| 3,542,350 | 11/1970 | Sherwood | 266/213 |

*Primary Examiner*—Gerald A. Dost

*Attorney, Agent, or Firm*—Parmelee, Miller, Welsh & Kratz

[57] ABSTRACT

Finely divided particulate material is discharged against the incandescent wall of a rotary furnace through a pipe extending into the open end of the furnace in a position where the material is out of the path of the flame projected into the furnace through the open end and out of the path of the out-flowing gases. The material is retained against the interior wall of the furnace by centrifugal force and, as the material melts, it collects in a pool at the inner end of the furnace. The entrainment of fine particles and their subsequent removal with the exhaust furnace gases is thereby substantially reduced, if not entirely eliminated.

2 Claims, 2 Drawing Figures

MELTING OF FINE PARTICULATE MATERIAL IN A HIGH-SPEED ROTARY FURNACE

This is a division of application Ser. No. 764,083 filed Jan. 31, 1977, now U.S. Pat. No. 4,094,667 issued June 13, 1978.

This invention relates to the melting of finely divided particulate materials, especially metallic ores and minerals in a direct-fired furnace while avoiding any substantial carry-out of the finely divided material as flue dust in the outflowing furnace gases. The invention is for an apparatus for the conversion of finely divided particulate material into a molten liquid wherein the particulate material may be, but not necessarily is, an ore which is also smelted as it is reduced to a liquid state.

The beneficiation of many metallic ores leaves the ore in a finely divided condition. If such finely divided material is introduced into a smelting furnace, a considerable part of it may be carried out of the furnace as dust in the effluent furnace gases. To avoid this loss of such ore in this way, it must first be agglomerated, as by sintering, pelletizing, or other procedures where individual particles are bonded into bodies of a convenient size for charging into a smelting furnace and thus be too large and heavy to be carried out of the furnace by the exhaust gases. Such agglomeration of the ore, of course, adds to the expense of the smelting operation and entails additional plant expense.

While this invention is especially useful in connection with the smelting of metal bearing ores, it may be useful in other operations where the introduction of finely divided batch material into a melting furnace is involved, as, for example, the manufacture of glass, glass fibers, frit and like products from finely divided batch materials.

This invention employs a familiar type of rotary furnace having a generally cylindrical chamber that is inclined upwardly toward its open end with a lance-type burner projected into said open end at an angle such that the flames impinge against the surface of a pool of molten material collected in the lower end of the furnace chamber, with the flames then being deflected upwardly and outwardly and in the reverse direction to discharge in the usual way from the said open upper end. The finely divided material to be melted is introduced into the furnace through a delivery pipe projecting into the open end of the furnace. It is blown or moved by gravity through the pipe in such manner as to be deposited in a generally continuous stream onto the incandescent lining of the furnace as the furnace is rotating. The discharge terminal of the pipe is located below and to one side of the axis of the fuel lance or burner near the forwardmost boundary of the pool of molten metal so that the material does not discharge directly into the pool but at some location between the entrance end of the furnace and that edge of the pool which is closest to the entrance end of the furnace, but not into the pool itself. In brief, the material to be melted is deposited on the lining of the furnace isolated from the high velocity gas stream resulting from the burning of fuel from the lance, both as such gases enter the furnace and as they leave. The furnace is rotated at a speed where the refractory lining is close to its critical speed and the material to be melted almost instantly acquires the speed of the refractory and is thereby held in place by centrifugal force adequate to prevent its dispersal by the gas stream while it quickly melts and flows into the molten pool within the furnace. Melting usually occurs in less than one revolution of the furnace.

The invention may be more fully understood by reference to the accompanying drawings, in which.

Figure 1:
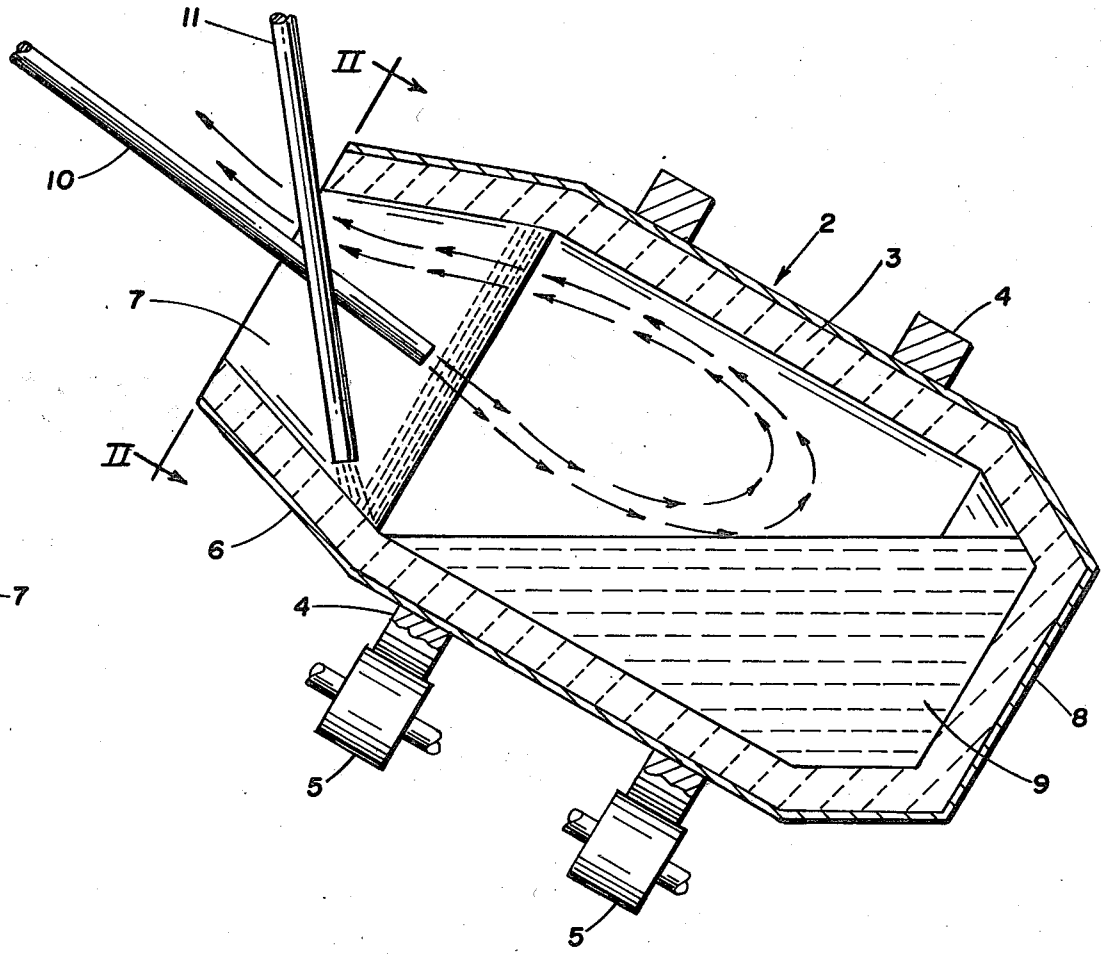
FIG. 1 is a schematic drawing representing generally a rotary furnace used in metallurgical processes, and especially in the refining of molten metal.

In the drawing, 2 designates generally the cylindrical outer metal shell of a rotary furnace with a refractory lining 3. Bearing rings 4 surround the shell and rest on rollers 5, at least some of which are power driven to rotate the furnace in a manner well understood in the art and forming no part, per se, of the present invention other than to support and rotate the furnace at the required speed. The furnace is of the customary design with a forwardly tapering portion 6 terminating in a central opening 7. The opposite or rear end 8 of the furnace is closed.

The supporting rollers 5 are so arranged that the longitudinal axis of the shell is at an angle to the horizontal. Arranged in this way, a pool of molten metal of rearwardly increasing depth may be retained in the furnace, as indicated at 9, while the refractory lining forwardly of this pool is not submerged. A burner or fuel injection lance 10 is entered into the opening in the forward end of the furnace at an angle to project burning gases against the surface of the pool. As indicated in the drawings, these gases impinge the surface of the pool, swirl upwardly and then forwardly, the spent gases escaping through the opening 7. Furnaces of this type are commonly arranged to be tilted to discharge the moltent metal by first withdrawing the lance and then tilting the furnace until the metal is poured out the open end, but since this is not material to the understanding of this invention, means for so tilting the furnace is not shown.

According to this invention, a material feed tube or lance 11 is entered into the open end of the furnace at a steeper angle than the burner lance, and the fine particulate ore is delivered through this lance, either by gravity or pressure and projected downwardly onto the surface of the refractory furnace lining at a place below and to one side of the burner lance terminal. The material, upon leaving the material lance, is deposited onto the furnace lining as the furnace is rotating and at a place forwardly of the pool 9 but inwardly of the opening 7. At this place, the material is out of the main stream of gases leaving the furnace as well as out of the path of the burning gases from the fuel lance. Moreover, the discharge end of the material lance is close to the inner surface of the furnace so that there is only a short free fall between the inner end of the material lance and the moving refractory wall onto which it falls.

Figure 2:
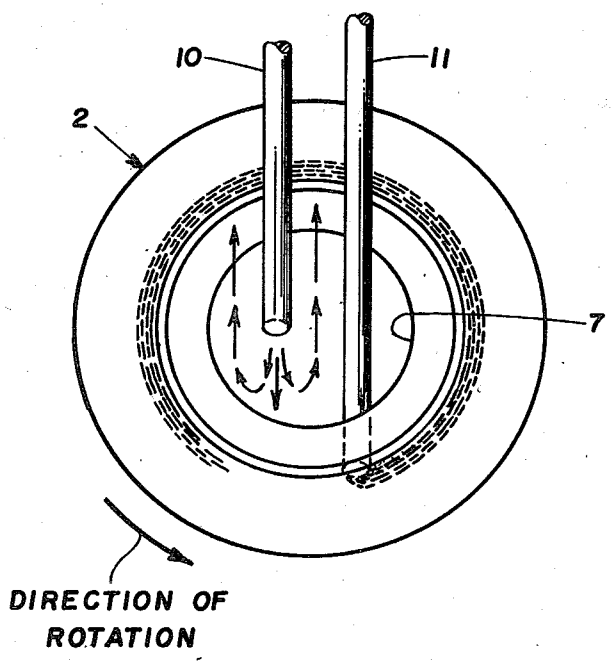
FIG. 2 is a transverse section in about the plane of line II—II of FIG. 1.

With the furnace rotating in the direction of the arrow in FIG. 2, the material which is deposited on the lining of the furnace is carried upward in a thin band or layer which is retained against the refractory lining by centrifugal force. Assuming that the interior of the furnace is ten feet in diameter, the critical speed at which centrifugal force is about equal to the weight of the particulate material is roughly about 24 RPM, which is a speed about equal to a velocity at the inside surface of the drum of about 760 feet per minute. The heat in the furnace is such that the layer of material deposited on the lining will generally melt in less than one complete revolution, and being held on the refractory lining by centrifugal force and being in the process of melting where the particles tend to cling together, the material will not be carried out by the spent gases leaving the furnace. As melting progresses, the fluid material will enter the pool and become a part of it, while a fresh layer of material is deposited with the next revolution of the furnace, the deposition of the particulate material and the melting of it taking place continuously until such time as the furnace needs to be tilted to discharge the accumulated melt. Slag may be produced with the melting of the ore particles and it will, of course, collect on the surface of the melt, but the interior walls of the furnace not covered by the melt will become highly heated and carry this heat with the rotation of the furnace into the molten pool beneath the slag. It is a well known phenomenon that solid particles will be held against the interior of a revolving drum at a much lower speed than the same material when it is reduced to a liquid state. For this reason, the speed of rotation of the drum, while adequate to carry the solids up and even over the highest point of revolution of the drum, is insufficient to affect the maintenance of a pool of liquid metal in the drum or prevent the flow of the particles when melted to a liquid from flowing into the pool.

Direct reduction of finely divided ores may thus be effected without appreciable removal of the ore particles with the furnace gases, making the preparation of the ore into agglomerates prior to smelting unnecessary.

While smelting of ores has been particularly described, other materials, such as glass batch materials and frit-forming materials and other heat fusible materials, may be reduced to a molten state in a similar manner.

I claim:

1. Apparatus for melting finely divided particulate material, comprising:

(a) an axially rotatable furnace of circular transverse section with an open forward end and having a closed rear end, the interior of the furnace having an area arranged to retain a pool of the molten material therein terminating inwardly from said open forward end, the interior of the furnace being lined with refractory;

(b) a material feeding lance projecting into the furnace through said open end, the lance having a discharge end terminating adjacent the lining of the furnace and the forward edge of the pool area of a pool of molten material when the pool has reached the limit which the furnace is designed to retain, the furnace lining sloping downwardly at the lowest point of revolution of the furnace lining adjacent the discharge end of the material feeding lance toward the rear end of the furnace but forwardly of the pool of molten material whereby particulate material discharged by the lance while the furnace is rotating will melt and drain into the pool area;

(c) a burner lance entered into the said open end of the furnace at a level above the discharge end of said material feeding lance, arranged to project a flame downwardly and toward the closed end of the furnace at an angle such that the flames impinge the surface of molten material in the pool at a level above the discharge end of the material feeding lance, the open end of the furnace providing the outlet for the combustion gases generated by the burner whereby the lining of the furnace at a level removed from the discharge end of the material feeding lance is heated as the furnace rotates to melt the particulate material after it has been deposited on the lining while avoiding entraining to any substantial extent the particulate material in said combustion gases; and (d) means for rotating the furnace about its axis of rotation at a speed sufficient to centrifugally retain said solid material against the refractory lining as it is carried by rotation of the furnace upwardly away from said low point of revolution until it liquefies and flows into the molten metal pool retaining area.

2. The combination with a rotary furnace having a cylindrical body with a forwardly tapering open end and having its axis of rotation inclined upwardly toward said forward open end, the body having a refractory lining and means for effecting rotation of the furnace, the body having a burner lance entered through its forward open end, the cylindrical body, by reason of the inclination of the axis of rotation, being adapted to provide a molten metal pool retaining area therein of forwardly decreasing depth, of a particulate material feed lance entered into the furnace through said open end and arranged to discharge on the furnace at its lowest point of rotation at a point forwardly of the pool of molten metal which the body is designed to hold and adjacent the forwardly tapering end of the furnace whereby there may be deposited on the interior of the furnace, near to but not in the pool of molten material, a continuous stream of particulate material to be carried by rotation of the drum until melted and flow into the pool, the burner lance being arranged to create a flame which is projected against the surface of the pool rearwardly of the shallow end, with the terminal of the material feed lance being below the burner lance and spaced from the flame generated by the lance, and means for rotating the furnace about its axis of rotation at a speed sufficient to centrifugally retain said solid material against the refractory lining as it is carried by rotation of the furnace upwardly away from said low point of revolution until it liquefies and flows into the molten metal pool retaining area.

* * * * *